United States Patent [19]

Fuchs

[11] 4,237,846

[45] Dec. 9, 1980

[54] PISTON

[75] Inventor: Reinhold Fuchs, Fellbach, Fed. Rep. of Germany

[73] Assignee: Mahler GmbH, Stuttgart, Fed. Rep. of Germany

[21] Appl. No.: 23,769

[22] Filed: Mar. 26, 1979

[30] Foreign Application Priority Data

May 13, 1978 [DE] Fed. Rep. of Germany ..... 2821176

[51] Int. Cl.[3] ..... F02F 3/02

[52] U.S. Cl. ..... 123/193 P; 92/176

[58] Field of Search ..... 123/191 A, 193 P, 191 R, 123/193 R, 193 CP; 92/176

[56] References Cited

U.S. PATENT DOCUMENTS

| | | | |
|---|---|---|---|
| 2,194,097 | 3/1940 | Reggio | 123/193 P |
| 3,385,175 | 5/1968 | Meier et al. | 92/176 |
| 4,083,292 | 4/1978 | Goloff | 92/176 |

FOREIGN PATENT DOCUMENTS

| | | | |
|---|---|---|---|
| 2546388 | 4/1977 | Fed. Rep. of Germany | 123/193 P |
| 18640 | of 1892 | United Kingdom | 123/193 P |

*Primary Examiner*—Craig R. Feinberg

*Attorney, Agent, or Firm*—Murray and Whisenhunt

[57] ABSTRACT

The piston for use in an internal combustion engine, more especially a diesel engine, is provided with a piston barrel consisting of light metal and a head plate which consists of a metal having a lesser thermal conductivity but a greater high-temperature strength, for example steel. The head plate is fastened to the piston barrel with the aid of retaining screws, which extend parallel to the piston axis and are preferably designed as expansion screws. The head plate is supported against the piston barrel only by a ring-shaped rib along a narrow ring rib through which the retaining screws pass. A radially outwardly widening gap is left free between the opposite faces of the ring-shaped rib formed on the head plate and the ring rib of the piston barrel at room temperature and when the retaining screws have not yet been tightened. The surface of the ring rib of the piston barrel is convexly curved in the radial direction.

The proposed curvature of the surface of the ring rib of the piston barrel has the advantage that the adjoining ring rib surface of the head plate finds for each oblique position an areal seating on the ring surface of the ring rib of the piston barrel.

Due to the proposed curvature of the lower gap surface, a smaller gap dimension can be chosen over the entire radial gap length than in the case of a gap consisting of plane surfaces.

5 Claims, 1 Drawing Figure

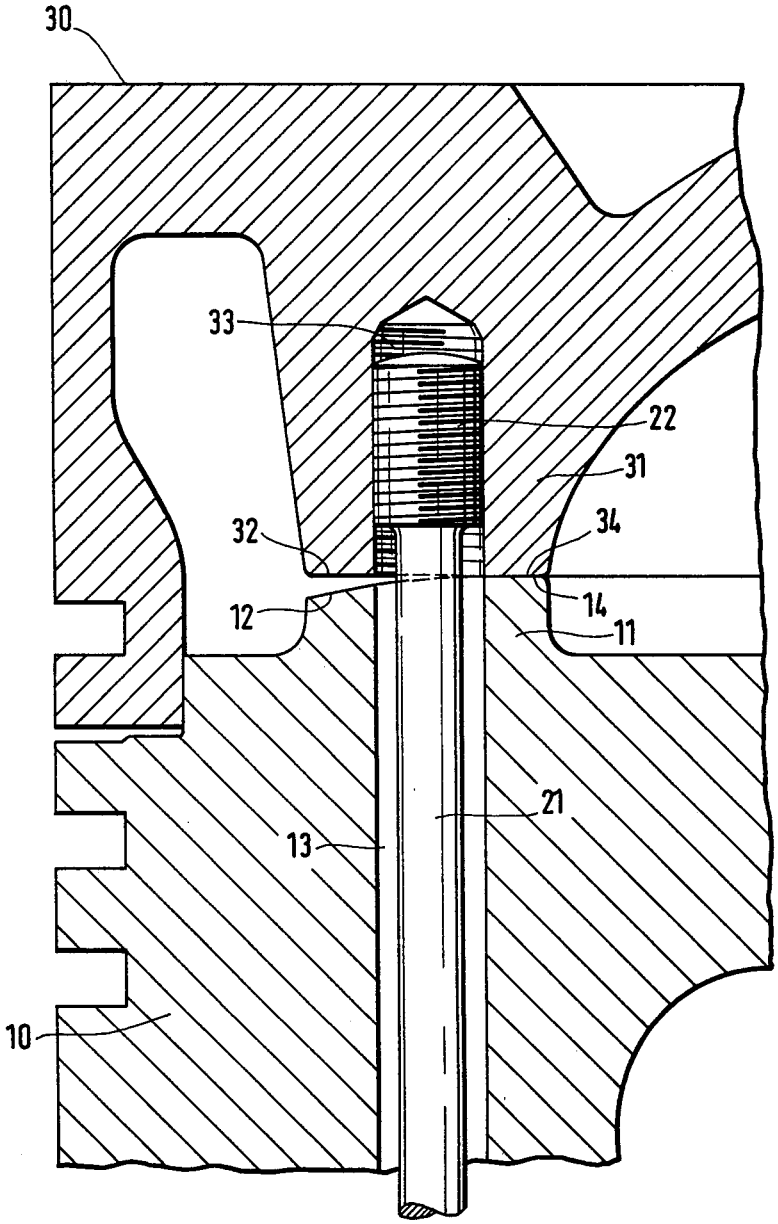
30
33
22
31
34
32
14
12
11
21
13
10

PISTON

BACKGROUND OF THE INVENTION

The invention relates to a piston for internal-cumbustion engines, more especially diesel engines, which is provided with a piston barrel consisting of light metal and a head plate which consists of a metal having a lesser thermal conductivity but a greater high-temperature strength, for example steel, and which is fastened thereto with the aid of retaining screws, which extend parallel to the piston axis, and are preferably designed as expansion screws, and which is supported against the piston barrel only by a ring shaped rib, along a narrow ring rib through which the retaining screws pass, and in which piston a radially outwardly widening gap is left free between the opposite faces of the ring shaped rib formed on the head plate and the ring rib of the piston barrel at room temperature and when the retaining screws have not yet been tightened.

STATEMENT OF PRIOR ART

Such a piston is known from DE AS 12 69 414.

The piston according to that publication comprises on the superimposed ring ribs of the head plate and the piston barrel an outwardly expanding gap with flat surfaces on the ring ribs.

The size of the gap is so designed that ideally the adjoining ring rib surfaces are completely located on top of one another during the engine operation at normal rating. This ideal case is mostly difficult to attain in practice and, over and above this, only applies to a very specific operational condition of the engine. In all other operational conditions it cannot be provided anyway.

The purpose of the gap between the superimposed ring ribs is explained in DE AS 12 69 414 as follows:

During the operation of an engine equipped with a piston consisting of a head plate and a piston barrel, the surface of the head plate that is directed towards the combustion chamber becomes hotter than its underside that is directed towards the piston barrel. As a result, the head plate bulges, its ring-shaped rib penetrated by the retaining screws having an oblique position and its front end that is directed towards the piston barrel tilting around its external edge and, in the area of its edge that is radially located farther to the inside, no longer abutting the piston barrel. The consequence thereof is that the retaining screws are simultaneously lengthened and bent to the outside. As a rule, the retaining screws do not withstand such a double stress. They therefore frequently crack, and the cracks regularly start at the point which is subjected to the most severe stress by the bending, namely on the radially inwardly located side of the screw shanks.

The gap proposed at the time is adapted to avoid this unfavorable stressing of the fastening members in a fairly satisfactory manner for specific singular operational conditions. However, in practice, the requirement exists to design the connection between the head plate and the piston barrel through the ring ribs in such a way that it is optimal not only in a specific operational condition but in as large a number of operational conditions as possible.

OBJECT OF THE INVENTION

To provide a satisfactory solution in this regard is the object of the present invention.

SUMMARY OF THE INVENTION

According to the invention there is provided a piston for internal combustion engines, comprising a piston barrel consisting of light metal, said piston barrel being formed with an annular rib, a head plate which consists of a metal having a lesser thermal conductivity but a greater high temperature strength, said head being formed with an annular rib which engages the annular rib on said piston barrel, and retaining means extending parallel to the piston axis through apertures in said rib, for supporting the head plate against the piston barrel only by said ribs, in which piston a radially outwardly widening gap is left free between the opposite faces of the annular ribs at room temperature and when the retaining screws have not yet been tightened, the surface of the annular rib of the piston barrel being convexly curved in the radial direction.

The proposed curvature of the surface of the ring rib of the piston barrel has the advantage that the adjoining ring rib surface of the head plate finds for each oblique position an areal seating on the ring surface of the ring rib of the piston barrel. Purely theoretically, this is indeed a line contact but practically an area contact will come about as a result of the elastic deformability of the materials. Due to the proposed curvature of the lower gap surface, a smaller gap dimension can be chosen over the entire radial gap length than in the case of a gap consisting of plane surfaces. By this means, the change in the length of the connecting screw caused by the oblique positioning of the head plate, whereby the gap is closed, is reduced and the screw pre-load is thus weakened to a lesser extent.

A special advantage of the solution according to the invention lies in that a relatively large contact area between the ring ribs of the head plate and the piston barrel is reliably ensured in all operational conditions of the engine, whereby so-called fritter phenomena in individual areas of the superimposed ring rib surfaces can be avoided. Such fritter phenomena, which are also termed fretting corrosion, arise due to slight relative movements ocurring between the seating surfaces. For example, this is the case if too small an angle is chosen for the gap and the head plate only rests on the outer edge of the ring rib surface when the operational heat causes it to bulge. Because the screw length change should be as minimal as possible, a linearly widening gap cannot in some cases be enlarged to such an extent as would be necessary with respect to the maximum bulging of the head plate. In contrast, the situation is different in connection with the lower surface of the gap which is convexly curved according to the invention, where the gap is exponentially enlarged to the outside and by this means a relatively small gap size can be specified in the area of the expansion screw.

With respect to the last-described problem, it may be advantageous to make the curvature proposed according to the invention smaller in the ring surface area that is external as viewed radially than in the internal area of the rib ring surface.

Further according to the invention, the curvature is largest on a narrow, radially outwardly located ring section. The measure proposed therein ensures that there will not occur on the external edge of the rib ring surface any linear compressions which are too great and may cause cracks to occur, particularly along the outer edge of the ring rib of the piston barrel.

BRIEF DESCRIPTION OF DRAWING

An exemplified embodiment of the invention is illustrated in the drawing, which shows a longitudinal section of the subject matter of the invention in a cold state by way of a cut-out.

DESCRIPTION OF PREFERRED EMBODIMENT

Only a portion of the head and the ring zone of the piston barrel 10, consisting of light metal, is shown. On the head of this piston barrel, there is provided a projecting rib 11 having a circular face 12 which is penetrated by bores 13 for the reception of retaining screws. The retaining screws each consist of an expansion shank 21, a threaded part 22 and a head now shown. The heads of the screws are supported against shoulders, which are also not shown, on the skirt of the piston barrel 10.

The head plate 30 comprises a ring-shaped rib 31 provided with a face 32 that is opposite to the face 12 of the piston barrel. This ring-shaped rib is penetrated by tapped holes 33 which are coaxial with the bores 13 of the piston barrel 10. A gap is formed between the faces 12 and 32. The face 12 is curved according to the invention. In the present case, an even radius of curvature has been chosen. But the radius of curvature may be varied. The gap width and the exact curvature of the surface of the ring rib of the piston barrel must be designed case by case in accordance with the bulging of the head plate which is to be expected in operation and which can be calculated in advance.

I claim:

1. A piston for internal-combustion engines, comprising (a) a piston barrel consisting of light metal, said piston barrel being formed with an annular rib, (b) a head plate which consists of a metal having a lesser thermal conductivity but a greater high-temperature strength, said head being formed with an annular rib which engages the annular rib on said piston barrel, and (c) retaining means extending parallel to the piston axis through apertures in said rib, for supporting the head plate against the piston barrel only by said ribs, in which piston a radially outwardly widening gap is left free between the opposite faces of the annular ribs at room temperature and when the retaining screws have not yet been tightened, the surface of the annular rib of the piston barrel which faces the opposed annular rib of the head plate being progessively convexly curved in the radial direction going from the longitudinal axis of the piston.

2. A piston according to claim 1, wherein the radius of curvature is sectionally reduced as the radial distance increases as viewed from the longitudinal axis of the piston.

3. A piston according to claim 1, wherein the radius of curvature is continually reduced as the radial distance increases as viewed from the longitudinal axis of the piston.

4. A piston according to claim 1, wherein the curvature is largest on a narrow, radially outwardly located ring section.

5. A piston according to claim 1, wherein the retaining means comprise expansion screws which screw into threaded bores formed in the piston head.

* * * * *

UNITED STATES PATENT AND TRADEMARK OFFICE

CERTIFICATE OF CORRECTION

PATENT NO. : 4,237,846

DATED : December 9, 1980

INVENTOR(S) : REINHOLD FUCHS

It is certified that error appears in the above—identified patent and that said Letters Patent is hereby corrected as shown below:

On the Title page,

Correct the name of the assignee to --Mahle GmbH--

Signed and Sealed this

*Seventh* Day of *September 1982*

[SEAL]

*Attest:*

GERALD J. MOSSINGHOFF

*Attesting Officer*

*Commissioner of Patents and Trademarks*